US008608009B2

(12) United States Patent
Ogawa

(10) Patent No.: US 8,608,009 B2
(45) Date of Patent: Dec. 17, 2013

(54) CONTAINER WITH LID

(75) Inventor: Masanori Ogawa, Hiroshima (JP)

(73) Assignee: FP Corporation, Hiroshima (JP)

( * ) Notice: Subject to any disclaimer, the term of this patent is extended or adjusted under 35 U.S.C. 154(b) by 0 days.

(21) Appl. No.: 13/576,299

(22) PCT Filed: May 19, 2011

(86) PCT No.: PCT/JP2011/061553

§ 371 (c)(1),
(2), (4) Date: Jul. 31, 2012

(87) PCT Pub. No.: WO2012/008221

PCT Pub. Date: Jan. 19, 2012

(65) Prior Publication Data

US 2012/0298682 A1 Nov. 29, 2012

(30) Foreign Application Priority Data

Jul. 15, 2010 (JP) ..... 2010-160475

(51) Int. Cl.
*B65D 41/06* (2006.01)
*B65D 41/36* (2006.01)
*B65D 39/00* (2006.01)

(52) U.S. Cl.
USPC ..... 220/302; 220/293; 215/252

(58) Field of Classification Search
USPC ..... 220/802, 288, 296, 298–302, 315, 220/324–326, 203.25, 293; 215/252, 321, 215/329–332, 335, 336, 337, 356, 357, 31
See application file for complete search history.

(56) References Cited

U.S. PATENT DOCUMENTS

| | | | | |
|---|---|---|---|---|
| 3,128,005 | A | 4/1964 | Sherlock | |
| 3,592,349 | A * | 7/1971 | Baugh | 215/307 |
| 4,699,285 | A * | 10/1987 | Perne et al. | 215/252 |
| 5,265,751 | A * | 11/1993 | Lima et al. | 220/288 |
| 5,310,074 | A | 5/1994 | Jochem et al. | |

(Continued)

FOREIGN PATENT DOCUMENTS

| | | |
|---|---|---|
| JP | 53-140178 | 12/1978 |
| JP | 8-295356 | 11/1996 |

(Continued)

*Primary Examiner* — Bryon Gehman
*Assistant Examiner* — Shawn Braden
(74) *Attorney, Agent, or Firm* — Hamre, Schumann, Mueller & Larson, P.C.

(57) ABSTRACT

A container body (20) includes an upper opening portion (21) having a container internal sidewall portion (22) and a container side skirt portion (24). A lid (10) includes a lid internal sidewall portion (12) and a lid side skirt portion (14). Two or more ledge portions (15) protruding inward are formed on the lid side skirt portion (14). The container side skirt portion (24) includes a first guide portion (30) for guiding downward the ledge portions (15) when the lid (10) is attached. When the lid is closed, the lid (10) is drawn into the side of the container body (20). Thus, a seal portion formed between the container internal sidewall portion (22) and the lid internal sidewall portion (12) is press-contacted, in the state of which the seal portion secures high sealability. Further, the length of the lid side skirt portion (14) is increased so as to cover the lower end of the container side skirt portion (24) with a lower portion of the lid side skirt portion (14) when the lid is attached or detached, whereby the fingertips can be prevented from being scratched.

17 Claims, 5 Drawing Sheets

(56) References Cited

U.S. PATENT DOCUMENTS

| | | | | |
|---|---|---|---|---|
| 5,320,233 | A * | 6/1994 | Welch | 215/252 |
| 5,462,186 | A | 10/1995 | Ladina et al. | |
| 6,056,145 | A * | 5/2000 | Rush et al. | 220/297 |
| 6,983,859 | B2 * | 1/2006 | Azzarello | 220/288 |
| 7,182,213 | B2 * | 2/2007 | King | 215/330 |
| 7,942,287 | B2 * | 5/2011 | King | 220/296 |
| 2005/0224498 | A1 | 10/2005 | Savicki | |

FOREIGN PATENT DOCUMENTS

| | | |
|---|---|---|
| JP | 2004-67140 | 3/2004 |
| JP | 2007-099288 | 4/2007 |
| JP | 2007-532417 | 11/2007 |
| WO | 2010/146997 | 12/2010 |

* cited by examiner (a)

(b)

CONTAINER WITH LID

TECHNICAL FIELD

The present invention relates to a container with lid.

BACKGROUND ART

A large number of containers with lid made of synthetic resin are mass-produced and consumed as containers for packed lunch, prepared foods, preserved foods, and other foods in supermarkets, convenience stores, and the like. Most of the containers with lid are manufactured for one time use only. However, some containers with lid contain foods such as umeboshi (sour pickled plum), rakkyo (pickled shallot), caviar, salmon roe, fruit, dried fruit, and salad, which cannot be used at a time. Thus, there is a demand for using a container with lid a plurality of times.

In this case, what matters is lid sealability. In light of this, Patent Literature 1, Patent Literature 2, and the like disclose a container with lid comprising a container body having an upper opening portion and a lid attachable to and detachable from the upper opening portion of the container body, wherein when the lid is attached to the container body, a circumferential simple seal portion is formed between a peripheral portion of the lid and the upper opening portion of the container body.

CITATION LIST

Patent Literature

Patent Literature 1: JP Patent Publication (Kokai) No. 2007-099288

Patent Literature 2: JP Patent Publication (Kokai) No. 8-295356 (1996)

SUMMARY OF INVENTION

Technical Problem

The container with lid of the Patent Literature 1 uses screw engaging to allow the lid to be attachable to and detachable from the container body in such a manner that a body side screw-threaded portion and an engaging portion are formed on a skirt portion of the container body side which is a sheet-formed product; and a lid side screw-threaded portion having the same shape as that of the body side screw-threaded portion and an engaging portion are formed on a skirt portion formed at a position facing the skirt portion of the container body on the lid side which likewise is a sheet-formed product. Then, the screw-threaded portion of the container body is threaded into the screw-threaded portion of the lid and further the engaging portion of the container body side is engaged with or fitted into the engaging portion of the lid side. Thus, a seal portion is formed therebetween, which can secure sealability. Further, the engaging portions are interlocked with each other so that both skirt portions of the container body and the lid are in close contact with each other, which can ensure higher sealability.

However, according to the Patent Literature 1, the engaging portion on the container body side which is formed from a sheet is formed on a skirt portion of the container body. Therefore, the engaging portion of the lid to be engaged with is also provided on a skirt portion of the lid. In other words, the skirt portions outside the container body and the lid which are formed from a sheet are weak in strength and susceptible to deformation. Thus, such an interlocking configuration with external skirt portions cannot exert sufficient sealability. Further, even if screw-threaded portions are provided on both the skirt portion outside the container body and the skirt portion outside the lid and both the screw-threaded portions are engaged with each other, sufficient sealability cannot be obtained for the same reason as described above. Furthermore, even if both the engaging portions and the screw-threaded portions are combined, sufficient sealability cannot be obtained because the skirt portions outside the container body and the lid which are formed from a sheet are easily deformed.

In addition, it is not easy to form screw-threaded portions with the totally same shape so that the skirt portions of the container body and the lid formed from a sheet can be screw-engaged with each other. If the screw-threaded portions with the totally same shape cannot be formed, sufficient sealability cannot be obtained likewise.

According to the container with lid of the Patent Literature 2, a projection body for sealing is formed on a horizontal flange portion of one of the container body portion and the lid portion over the entire circumference and a groove for sealing the projection body engaged when the lid is closed is formed on the other over the entire circumference. Further, the container with lid comprises a projection body guide portion for guiding the projection body upward and directing it in a direction of removing the lid portion when the lid portion is removed from the container body portion.

However, only the projection body and the groove having the above structure cannot press the container body and the lid portion tightly with each other and thus cannot ensure high sealability. This is because the projection body guide portion provided on the container disclosed in Patent Literature 2 has a configuration which can guide the projection body upward in opening and direct it in a direction of removing the lid portion, but cannot press the lid and container body tightly with each other when the lid is closed, and thus does not produce a force of pressing the flange portion formed on the lid downward, namely, a force of pressing the flange portion formed on the lid against a surface of the flange portion formed on the container body.

In view of the above circumstances, the present invention has been made, and an object of the present invention is to provide a container with lid such that even if the container with lid is formed from a sheet, the container with lid is easy to be formed, can ensure sufficient sealability in an easy and reliable manner when the lid is closed, and the lid is easily attachable to and detachable from the container.

Solution to Problem

In order to solve the above problems, the present inventors have made a large number of experiments and have found that high sealability is obtained by a press-fit state of the lid against a sidewall portion inside the container body because the sidewall portion inside the container body is hard to be deformed. Further, the present inventors have found that a high press-fit state between the container body and the lid can be stably formed by forming a guide surface on a skirt portion of the container body and moving a protrusion formed on the lid along the guide surface. The present invention is based on the above findings.

More specifically, a first embodiment of a container with lid according to the present invention includes: a container body having a substantially circular upper opening portion; and a lid attachable to and detachable from the upper opening portion of the container body, wherein when the lid is attached to the container body, a circumferential liquid-tight seal portion is formed between a peripheral portion of the lid and the upper opening portion of the container body. The upper opening portion of the container body includes at least: a container internal sidewall portion continuing to a sidewall of the container body; a first flange portion extending in a horizontal direction from an upper end of the container internal sidewall portion; and a container side skirt portion extending downward from an outer edge of the first flange portion. The peripheral portion of the lid includes at least: a lid internal sidewall portion having a region capable of press-contacting with the container internal sidewall portion over the entire circumference when the lid is attached to the container body; a second flange portion extending in a horizontal direction from the upper end of the lid internal sidewall portion; and a lid side skirt portion extending downward from an outer edge of the second flange portion. Further, two or more ledge portions protruding inward are formed on the lid side skirt portion. In a state in which a lower edge side of the ledge portion formed on the lid side skirt portion press-contacts against the first flange portion formed on an upper opening portion of the container body, a container side skirt portion is formed such that the lower end of the container side skirt portion is positioned lower than the lower end of the lid side skirt portion. The container side skirt portion of the container body has a first guide portion that can guide downward the ledge portion formed on the lid side skirt portion when the lid is attached. When the lid is closed, the ledge portions are guided downward by the first guide portion and thereby the lid is drawn in downward. Thus, the seal portion formed between the container internal sidewall portion and the lid internal sidewall portion is press-fitted, in the state of which the seal portion secures high sealability.

The above container with lid is such that when the lid is closed, the ledge portions formed on the lid are guided downward by the first guide portion formed on the container side skirt portion and thereby the lid is caused to move downwardly. Then, by being drawn in, the region capable of press-contacting with the container internal sidewall portion over the entire circumference in the lid internal sidewall portion and the container internal sidewall portion are in a state of being pressed and fitted with each other. For this reason, a circumferential liquid-tight seal portion having a high sealability is formed between the container internal sidewall portion and the lid internal sidewall portion.

Further, the operation of closing the lid is sufficient to simply turn the lid in a tightening direction because the ledge portions formed on the lid are configured to be guided downward by the first guide portion formed on the container side skirt portion. Therefore, when the turn completes, the circumferential liquid-tight seal portion having the high sealability is formed.

Further, in the container with lid according to the present invention, as described above, the circumferential liquid-tight seal portion is formed not on the skirt portion but on the container internal sidewall portion continuing to the sidewall of the container body. The portion of the container internal sidewall portion continuing to the sidewall of the container body is a region unsusceptible to deformation caused by an external force in comparison with the skirt portion formed from an upper portion of the container body to outside downward, and thus can prevent a liquid-tight seal portion from being damaged after the lid is closed with high probability.

Further, when the lid is attached, the container body is held with one hand and the lid is held from above with the other hand, in the state of which the lid is placed on the upper opening portion of the container body and the lid is turned in the tightening direction. In a position in which the lid is placed on the upper opening portion of the container body, the lower end side of the ledge portion formed on the lid side skirt portion press-contacts against the first flange portion formed on the upper opening portion of the container body. In the container with lid according to the first embodiment, in that state, the lid side skirt portion is formed such that the lower end of the lid side skirt portion is positioned lower than the lower end of the container side skirt portion. Accordingly, during the period from the start of the tightening of the lid to the end of the tightening thereof, the fingertips of a person holding the lid do not contact a lower end edge of the container side skirt portion. Particularly, when the lid is attached, the force required to turn the lid becomes larger than before as the ledge portion formed on the lid side skirt portion is guided downward along the first guide portion, and a larger force than before is applied to the fingertips. As described above, during the period from the start of the tightening of the lid to the end of the tightening thereof, the fingertips of a person holding the lid do not contact a lower end edge of the container side skirt portion. Thus, even if a force is applied to the fingertips, it does not occur that the fingertips are scratched by contacting the lower end edge of the container side skirt portion.

From when the lid starts to be detached until the lid is freed from the container body, namely, until the lower end side of the ledge portion formed on the lid side skirt portion is released from the upper surface of the first flange portion formed on the upper opening portion of the container body, the fingertips of a person holding the lid do not contact a lower end edge of the container side skirt portion. In the container with lid of the first embodiment, particularly when the lid is detached, in a state in which the lower end side of the ledge portion formed on the lid side skirt portion press-contacts against the upper surface of the first flange portion formed on the upper opening portion of the container body, it may occur that the lid is further turned in a peripheral direction. However, in the container with lid of the first embodiment, in that state, as described above, the lid side skirt portion is formed longer than the container side skirt portion such that the lower end of the lid side skirt portion is positioned lower than the lower end of the container side skirt portion, in the state of which the lower end of the container side skirt portion is not exposed. Thus, when the lid is turned to be detached, it is possible to avoid the fingertips of a person holding the lid from carelessly contacting a lower end edge of the container side skirt portion. Thus, it does not occur that the fingertips are scratched by contacting the lower end edge of the container side skirt portion.

Further, the container with lid of the first embodiment includes the first and second horizontal flange portions, whereby it is difficult for the upper opening portion of the container body and the peripheral portion of the lid to be subjected to deformation caused by an external force and it is possible to prevent the liquid-tight seal portion from being damaged with a further high probability. Furthermore, in the above embodiment, when the lid is closed, the ledge portion is guided downward by the first guide portion and the lid is drawn in downward, whereby it is also possible that the first flange portion and the second flange portion are press-fitted with each other. When the two flange portions are press-fitted with each other, a circumferential liquid-tight seal portion is formed as a second seal portion in that region, whereby it is possible to obtain a container with lid with further high sealability.

A second embodiment of a container with lid according to the present invention includes: a container body having a substantially circular upper opening portion; and a lid attachable to and detachable from the upper opening portion of the container body, wherein when the lid is attached to the container body, a circumferential liquid-tight seal portion is formed between the peripheral portion of the lid and the upper opening portion of the container body. The upper opening portion of the container body includes at least: a container internal sidewall portion continuing to a sidewall of the container body; and a container side skirt portion extending downward from an upper end of the container internal sidewall portion. The peripheral portion of the lid includes at least: a lid internal sidewall portion having a region capable of press-contacting with the container internal sidewall portion over the entire circumference when the lid is attached to the container body; and a lid side skirt portion extending downward from an upper end of the lid internal sidewall portion. Further, two or more ledge portions protruding inward are formed on the lid side skirt portion. The container side skirt portion of the container body includes a first guide portion that can guide downward the ledge portion formed on the lid side skirt portion when the lid is attached; and a second guide portion that can guide upward the ledge portion in a position in which a lower end side of the ledge portion is in contact when the lid attached to the container body is detached. A part of the second guide portion has a horizontal region substantially parallel to an upper end of the container internal sidewall portion. In a state in which the lower end side of the ledge portion in the lid side skirt portion press-contacts against the horizontal region of the second guide portion, the container side skirt portion is formed such that the lower end of the container side skirt portion is positioned lower than the lower end of the lid side skirt portion. When the lid is closed, the ledge portions are guided downward by the first guide portion, and thereby the lid is drawn in downward, and thereby the seal portion formed between the container internal sidewall portion and the lid internal sidewall portion is press-fitted, in the state of which the seal portion secures high sealability.

The container with lid of the second embodiment behaves in substantially the same manner as the container with lid of the first embodiment when the lid is attached, but behaves differently when the lid is detached. More specifically, the container with lid of the second embodiment includes the second guide portion that can guide upward the ledge portion in a position in which the lower end side of the ledge portion contacts the container side skirt portion. A part of the second guide portion has a horizontal region substantially parallel to an upper end of the container internal sidewall portion. When the lid is detached, the ledge portion formed on the lid side skirt portion is guided upward by the second guide portion, whereby it is very easy to operate when the lid is detached. Further, in the course of guiding, the protrusion passes through the horizontal region, whereby stability can be secured during detaching operation.

Of course, when the lid is closed, the second guide portion can be used as a guide portion on the lower end side of the ledge portion, whereby it is easier to operate when the lid is closed. Further, when the lid is closed, the lower end side of the ledge portion is placed on the horizontal region, and from that state, the lid is turned in the tightening direction, whereby the ledge portion can be easily guided to the position of the first guide portion.

Even in the container with lid of the second embodiment, when the lid is attached or when the lid is detached, it is possible to avoid the fingertips of a person holding the lid from being scratched by contacting a lower end edge of the container side skirt portion. More specifically, in the container with lid of the second embodiment, when the lid is attached, the lid is turned so as to move the projected portion along the first guide portion from the horizontal region formed on the second guide portion, and when the lid is detached, the lid is turned so as to move the projected portion from the first guide portion to the horizontal region formed on the second guide portion, at the time of which a large force is applied to the fingertips holding the lid. In the container with lid of the second embodiment, in a state in which the lower end side of the protrusion in the lid side skirt portion press-contacts against the horizontal region of the second guide portion, the lid side skirt portion is formed such that the lower end of the lid side skirt portion is positioned lower than the lower end of the container side skirt portion. Thus, in a state in which a force is applied to the fingertips, the fingertips do not contact the lower end edge of the container side skirt portion. Therefore, it does not occur in the container with lid of the second embodiment that the fingertips are scratched when the lid is attached or when the lid is detached.

In a preferred embodiment of the container with lid of the second embodiment, the first guide portion does not exist above the horizontal region of the second guide portion. In this embodiment, the first guide portion does not exist above the horizontal region, leading to an upward open state. Therefore, when the lid is closed, the lower end side of the ledge portion can be easily placed on the horizontal region. Then, from that state, the lid is turned in the tightening direction and thereby the ledge portion can be easily guided to the position of the first guide portion.

In the container with lid of the first and the second embodiments described above, specific embodiments for forming the circumferential liquid-tight seal portion are not limited, but for example, the container internal sidewall portion and the lid internal sidewall portion have a cylindrical surface or an upward-expanding cone surface. More specifically, examples of the embodiments include: (A) $r1 \geq r3$ and $0° \leq \theta 1 < \theta 2$, where r1 denotes the radius of an upper end of the lid internal sidewall portion, r3 denotes the radius of an upper end of the container internal sidewall portion, $\theta 1$ denotes the tilt angle of the container internal sidewall portion, and $\theta 2$ denotes the tilt angle of the lid internal sidewall portion 12 with respect to a vertical centerline; (B) $r1 \leq r3$ and $\theta 1 > \theta 2 \geq 0°$; or (C) $r1 > r3$ and approximately $\theta 1 = \theta 2 \neq 0°$.

Furthermore, in the container with lid of the first and second embodiments, a plurality of longitudinal reinforcing ribs may be formed on the lid side skirt portion of the lid. This embodiment can increase the strength of the lid side skirt portion of the lid, and thereby can prevent the deformation of the lid and can make the lid hard to slide at attaching and detaching thereof.

Furthermore, in the container with lid of the first and second embodiments, both the container body and the lid are a sheet-formed product made of a synthetic resin sheet. As described above, in the container with lid in the present invention, the first guide portion for guiding the ledge portions formed on the lid is provided on the container side skirt portion of the container body side. Therefore, even if both the container body and the lid have a shape susceptible to deformation by an external force such as a sheet-formed product, the lid tightening operation can be performed in a stable and reliable manner.

This description incorporates the contents in the description and/or the drawings in Japanese Patent Application No. 2010-160475 to which this application claims priority.

Advantageous Effects of Invention

The present invention can provide a container with lid made of a thin sheet of synthetic resin with high sealability.

Further, the present invention can provide a container with lid which allows attaching and detaching to be performed easily and repeatedly and can prevent the fingertips holding the lid from being scratched. Furthermore, the present invention can provide a container with lid which is easier to be molded than a conventional container.

DESCRIPTION OF EMBODIMENTS

Figure 1:
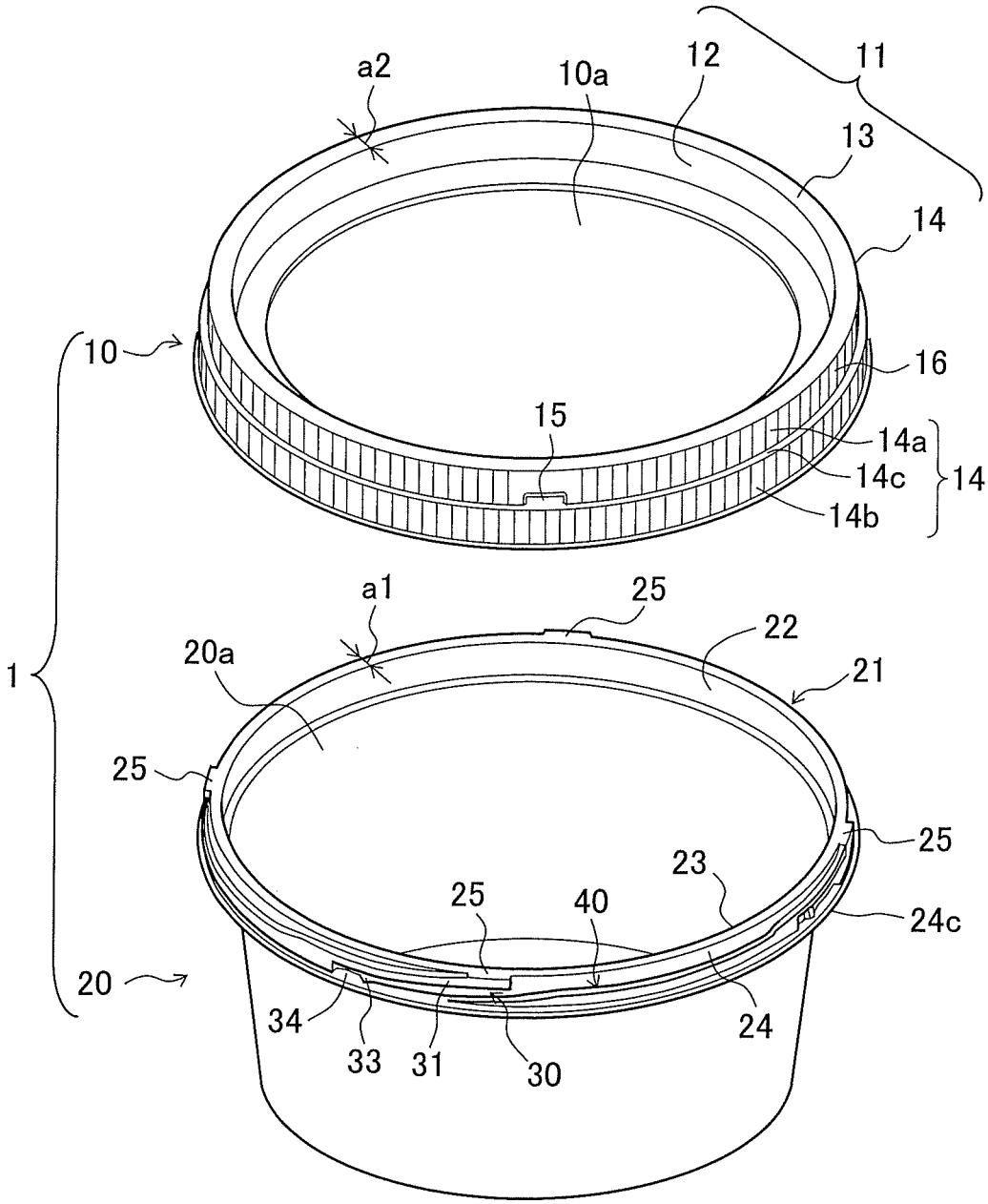
FIG. 1 is a perspective view illustrating an embodiment of a container with lid according to the present invention in a state in which the container body is separated from the lid.
Figure 2:
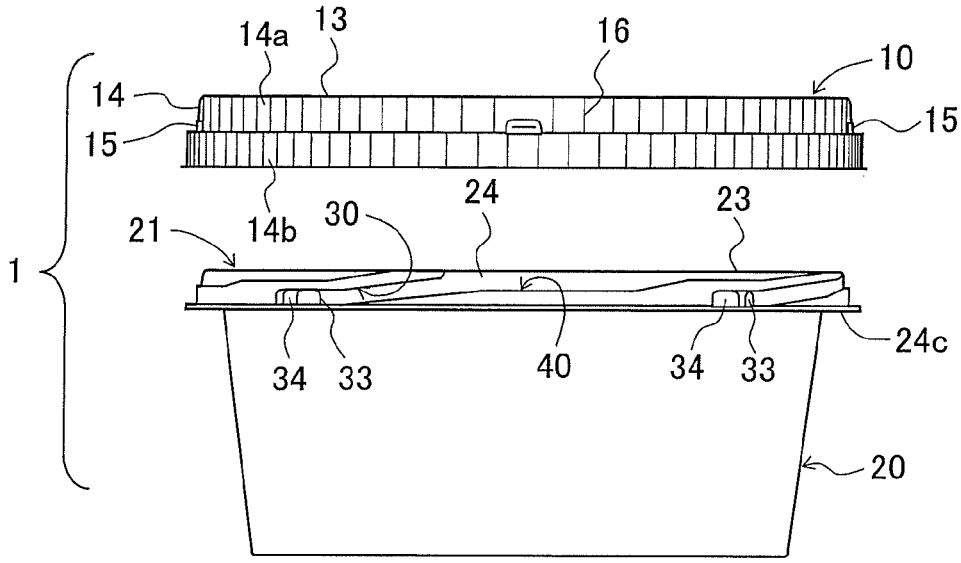
FIG. 2 is a side view of FIG. 1.
Figure 3:
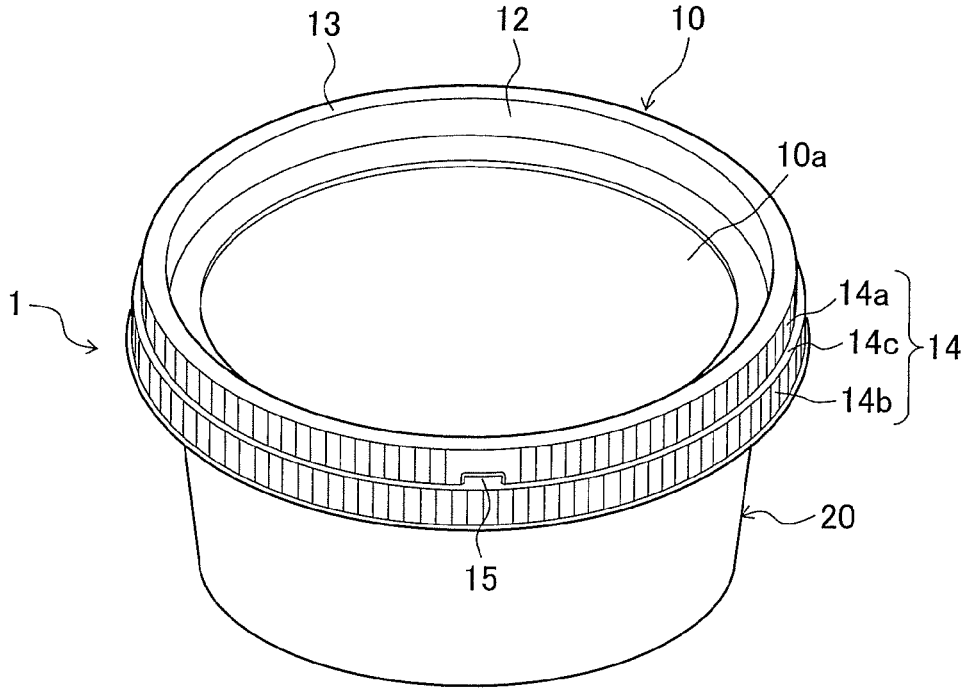
FIG. 3 illustrates the container with lid in a state in which the lid is closed.

Hereinafter, some embodiments of the present invention will be described by referring to the accompanying drawings. The container with lid 1 includes a lid 10 and a container body 20 having an upper opening portion 21 covered with the lid 10. In this example, though not limited, the lid 10 and the container body 20 are a sheet-formed product thermally formed of a thin synthetic resin sheet with a thickness of about 0.2 to 1.0 mm.

In this embodiment, the lid 10 is circular or substantially circular and includes a lid top surface portion 10*a* and a peripheral portion 11 continuing to the lid top surface portion 10*a*. The peripheral portion 11 includes a lid internal sidewall portion 12 rising from an outer edge of the lid top surface portion 10*a*; an annular second flange portion 13 with a width of a2 extending in a horizontal direction from an upper end of the lid internal sidewall portion 12; and a lid side skirt portion 14 extending downward from an outer edge of the second flange portion 13. In this example, the lid side skirt portion 14 includes a lid side upper skirt portion 14*a*; a reinforcing horizontal flange 14*c* extending in a horizontal direction from the lower end of the lid side upper skirt portion 14*a*; and a lid side lower skirt portion 14*b* extending downward from the outer edge of the reinforcing flange 14*c*. Two or more (four in the illustrated example) inward protruding ledge portions 15 are formed with a circumferentially equal distance near the lower end of the lid side upper skirt portion 14*a*. Note that the downward extending distance of the lid side lower skirt portion 14*b*, namely, the length of the lid side lower skirt portion 14*b* extending downward from the reinforcing horizontal flange 14*c* and its effect will be described later.

Though not required, a large number of ribs 16 are also longitudinally formed on the lid side skirt portion 14 so as to exert not only support effects but also anti-slip effects when the lid is attached or detached. Note that the illustrated second flange portion 13 has a flat plate shape, but may have a non-flat plate shape such as an arc shape. Further, the second flange portion 13 may be omitted and the lid side skirt portion 14 may be formed directly downward from the upper end of the lid internal sidewall portion 12.

The container body 20 has a bottomed cylindrical shape with a predetermined depth and includes the upper opening portion 21 continuing to an upper edge of a container body sidewall 20*a* formed upward from a peripheral edge of a bottom surface of the container body 20. The upper opening portion 21 includes a container internal sidewall portion 22 continuing to an upper edge of the container body sidewall 20*a*; an annular first flange portion 23 with a width a1 (<a2) extending in a horizontal direction from an upper end of the container internal sidewall portion 22; and a container side skirt portion 24 extending downward from an outer edge of the first flange portion 23. The length of the container side skirt portion 24 is substantially the same as the length of the above lid side upper skirt portion 14*a*. The lower end of the container side skirt portion 24 includes a reinforcing horizontal flange 24*c* of a size enough to place the reinforcing flange 14*c* of the lid side skirt portion 14 thereon. The container side skirt portion 24 includes guide portions 30, 40, and the like (described later) for guiding the ledge portions 15 formed on the lid 10. Note that preferably the inward width (depth) of the ledge portions 15 formed on the lid 10 is substantially equal to or slightly smaller than the difference P between the width a2 of the second flange portion 13 and the width a1 of the first flange portion 23.

Although the illustrated first flange portion 23 has a flat plate shape, but if the second flange portion 13 has a non-flat plate shape such as an arc shape, the first flange portion 23 has a shape corresponding thereto. If the second flange portion 13 is omitted, the container side skirt portion 24 is formed directly downward from the upper end of the container internal sidewall portion 22 of the container body 20.

When the lid is closed, the container internal sidewall portion 22 becomes a region contacting with the lid internal sidewall portion 12 formed on the lid 10. When the lid 10 is attached to the container body 20, the lid internal sidewall portion 12 is configured to have a region capable of press-contacting with the container internal sidewall portion 22 over all the entire circumference. Thus, a circumferential liquid-tight seal portion is formed between the container internal sidewall portion 22 and the lid internal sidewall portion 12. By referring to FIG. 4, some specific embodiments of forming the circumferential liquid-tight seal portion will be described.

Figure 4:
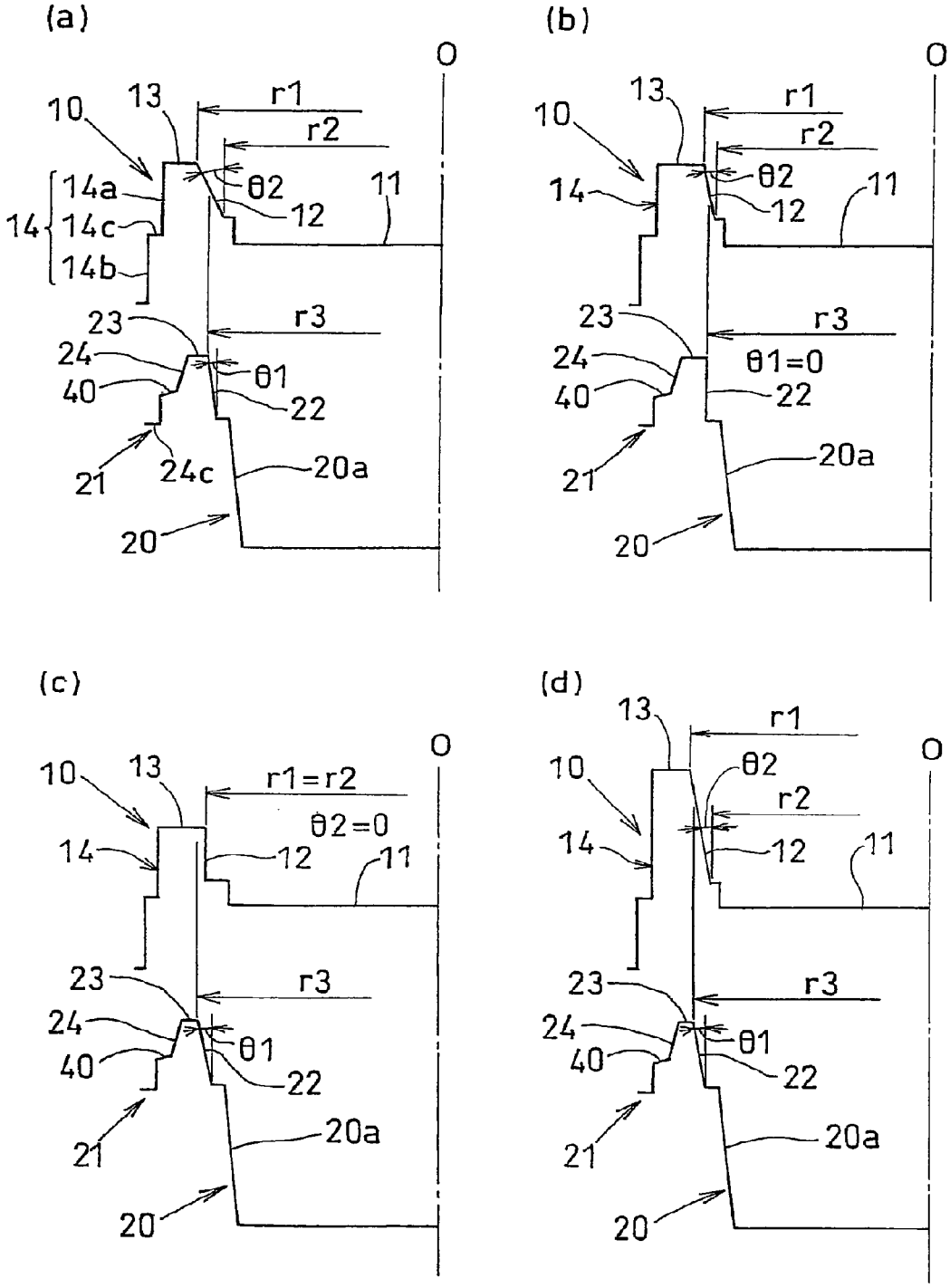
FIG. 4 is a sectional view illustrating the essential parts of the container with lid according to the present invention.

In an embodiment of FIG. 4(*a*), the container internal sidewall portion 22 and the lid internal sidewall portion 12 each have an upward-expanding cone surface; and satisfy $r1 \geq r3 > r2$, where r1 denotes the radius of an upper end of the lid internal sidewall portion 12, r2 denotes the radius of a lower end thereof, and r3 denotes the radius of an upper end of the container internal sidewall portion 22; and $0° < \theta 1 < \theta 2$, where θ1 denotes the tilt angle of the container internal sidewall portion 22 and θ2 denotes the tilt angle of the lid internal sidewall portion 12 with respect to a vertical centerline O. In this embodiment, when the lid is closed, a circular upper end portion of the container internal sidewall portion 22 press-contacts with the cone surface of the lid internal sidewall portion 12 over the entire circumference totally. Then, the press-contacting portion forms a circumferential seal portion.

FIG. 4(*b*) is different from FIG. 4(*a*) in that θ1 is 0°, that is, the container internal sidewall portion 22 have a cylindrical surface. In this embodiment, likewise, when the lid is closed, a circular upper end portion of the container internal sidewall portion 22 press-contacts with the cone surface of the lid internal sidewall portion 12 over the entire circumference. Then, the press-contacting portion forms a circumferential seal portion.

In an embodiment of FIG. 4(*c*), θ2 is 0°, that is, the lid internal sidewall portion 12 has a cylindrical surface, and thus r1=r2. Moreover, r3>r1 and θ1>0°. In this embodiment, when the lid is closed, the cylindrical surface of the lower end portion of the lid internal sidewall portion 12 press-contacts with the cone surface of the container internal sidewall portion 22 over the entire circumference. Then, the press-contacting portion forms a circumferential seal portion. Note that although not illustrated, if the relation of θ1>θ2 is satisfied, even if the lid internal sidewall portion 12 has a cone surface, the same or similar seal portion is formed.

In an embodiment of FIG. 4(*d*), r1>r3 and θ1=θ2≠0°. In this embodiment, when the lid is closed, the cone surface of the container internal sidewall portion 22 contacts the cone surface of the lid internal sidewall portion 12 to form a circumferential seal portion.

Next, by referring to FIG. 5, the guide portions 30, 40, and the like will be described. First, the first guide portion 30 will be described. The first guide portion 30 is radially outwardly projected from the container side skirt portion 24 and includes a sloping portion 35 inclined obliquely downward from the first flange portion 23 which is an upper end of the container side skirt portion 24. In this example, the lower end portion 26 of the sloping portion 35 forms a horizontal portion 32 projecting radially outwardly in a position parallel to the first flange portion 23 which is an upper end surface of the container side skirt portion 24.

The amount of radial outward projection of the first guide portion 30 is small in a portion 25 contacting the first flange portion 23, becomes gradually larger as it goes downward, and is the largest at the horizontal portion 32 which is the lower end portion 26. The amount of projection at the largest portion is substantially equal to the difference P between the width a2 of the second flange portion 13 and the width a1 of the first flange portion 23. Moreover, a rising wall 31 rising upward from an outer edge of the sloping portion 35 and the horizontal portion 32 of the first guide portion 30 is formed.

The rising wall 31 extends farther backward beyond the horizontal portion 32 (in the left direction in the figure) concentrically with the container side skirt portion 24 of the upper opening portion 21. As described above, the amount of projection in the horizontal portion 32 is substantially equal to the difference P between the width a2 of the second flange portion 13 and the width a1 of the first flange portion 23. Therefore, the distance between the radial position of the concentrically extending portion 31*a* of the rising wall 31 and the container internal sidewall portion 22 of the upper opening portion 21 of the container body 20 is substantially equal to the width a2 of the second flange portion 13 of the lid 10. Thus, when the lid is closed, the internal surface of the lid side skirt portion 14 of the lid 10 can substantially be in contact with the concentrically extending portion 31*a* of the rising wall 31. Note that the concentrically extending portion 31*a* of the rising wall 31 forms a rising wall portion of the second guide portion 40 as described later.

In the above, the distance h from the upper end portion of the horizontal portion 32 to the first flange portion 23 is greater than the distance H from the top surface of the ledge portion 15 formed near the lower end of the lid side upper skirt portion 14*a* of the lid 10 to the second flange portion 13 of the lid 10 (see FIG. 5), but this configuration is not required. As described later, the relation between the distance H and the distance h may be arbitrary as long as the container internal sidewall portion 22 and a region capable of press-contacting against the container internal sidewall portion 22 of the lid internal sidewall portion 12 over the entire circumference can be in a state of being press-fitted with each other in such a state in which when the lid 10 is closed, the ledge portion 15 is guided downward by the first guide portion 30 and thereby the lid 10 is drawn in downward.

Note that the number of the first guide portions 30 is the same as the number of ledge portions 15 formed on the lid 10. In this example, four first guide portions 30 and four ledge portions 15 are formed. Preferably, the circumferential length of the first guide portion 30 is substantially one-eighth (⅛) of the circumference of the upper opening portion 21 of the container body 20.

Bumps 33*a* and 33*b* slightly radially protruding from a surface of the container side skirt portion 24 are formed near a terminal portion of the horizontal portion 32. Thus, a hollow portion 34 is foamed between the bumps 33*a* and 33*b*.

Next, the second guide portion 40 will be described. The second guide portion 40 is also radially outwardly projected from the container side skirt portion 24. As illustrated in the figure, the second guide portion 40 is located circumferentially in the front of the horizontal portion 32 of the first guide portion 30 (in the right direction in the figure). The second guide portion 40 is formed gradually obliquely upward starting at a lower edge level position of the hollow portion 34, and the upper end of the second guide portion 40 reaches the first flange portion 23 which is the upper end surface of the container side skirt portion 24. In this example, the second guide portion 40 includes a first sloping region 41, followed by a horizontal region 42 parallel to an upper edge surface of the container side skirt portion 24, and followed by a second sloping region 43.

In the illustrated example, the first sloping region 41 and the subsequent horizontal region 42 have a shape obtained by horizontally inward bending an appropriate place of the concentrically extending portion 31*a* of the rising wall 31; and part of the horizontal region 42 and the second sloping region 43 have a shape obtained by horizontally bending an appropriate place of the rising wall 31. Moreover, the first guide portion 30 does not exist above the horizontal region 42 and the second sloping region 43 of the second guide portion 40.

Further, the distance between the first guide portion 30 and the second guide portion 40 in a region in which the first guide portion 30 exists above the second guide portion 40 is a distance allowing the ledge portions 15 formed on the lid 10 to pass through in a horizontal position.

Next, an operation of attaching the lid 10 to the container body 20 will be described. When the lid is attached, the peripheral portion 12 of the lid 10 is placed on the upper opening portion 21 of the container body 20, in the state of which the lid is slightly pressed downward. Then, except that four ledge portions 15 of the lid 10 press-contact against the portion 25 (projecting portion at an upper end of the first guide portion 30) of the first flange portion 23 of the container body 20, the lid 10 sinks downward in a position in which an internal side surface of the ledge portion 15 is in contact with the container side skirt portion 24 of the container body 20. When the ledge portions 15 press-contact against the portion 25, the lid 10 is slightly turned.

When the lid 10 sinks in, the lower end side of the ledge portion 15 press-contacts against any position of the second guide portion 40 and moves on at least the horizontal region 42. In that state, when the lid 10 is further turned clockwise in the figure, in the course of turning, the upper edge portion on the front side in the turning direction of each ledge portion contacts the first guide portion 30.

Figure 7:
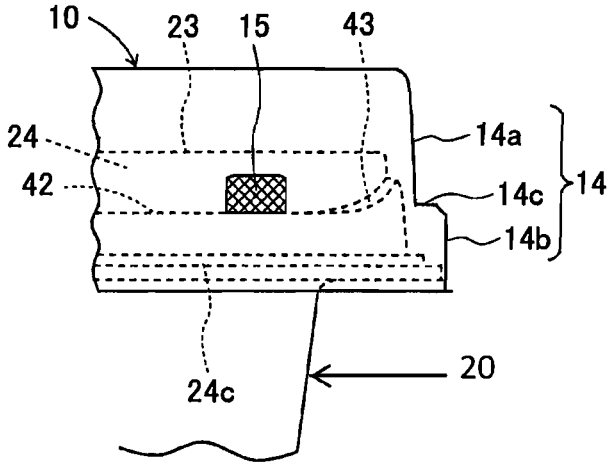
FIG. 7 is a view for describing the length and its effects of the lid side skirt portion.
Figure 7:
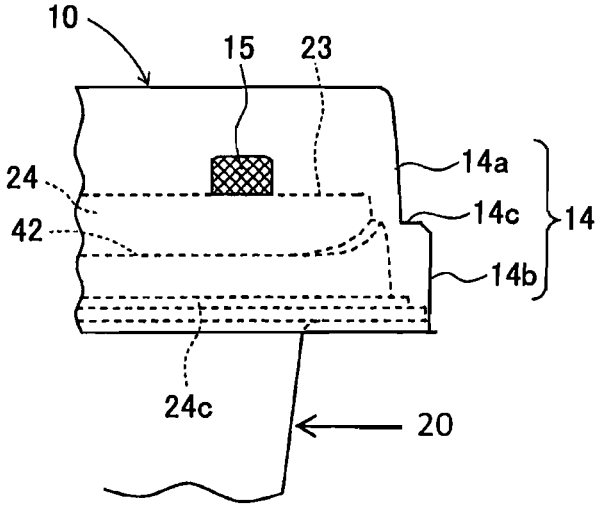

In an embodiment of the lid 10, as illustrated in FIG. 7(*a*), in a position in which the lower end side of the ledge portion 15 is placed on the horizontal region 42 of the second guide portion 40, namely, in a state in which the lower end side of the ledge portion 15 press-contacts against the horizontal region 42 of the second guide portion 40, the lid side skirt portion 14 is formed such that the lower end of the lid side skirt portion 14 is positioned lower than the lower end of the container side skirt portion 24. In the above example, the lid side upper skirt portion 14*a* of the lid side skirt portion 14 is formed to have a predetermined length from the relation of the container side skirt portion 24 of the container body 20. Note that here the lower end of the container side skirt portion 24 is located at the reinforcing horizontal flange 24*c* formed at the lower end of the container side skirt portion 24.

When the lid is attached, it is common that the container body 20 is held with one hand and the lid 10 is held from above with the other hand, in the state of which the lid 10 is placed on the upper opening portion 21 of the container body 20 and subsequently, the lid 10 is turned. At that time, the resistance is low until the ledge portion 15 contacts the first guide portion 30 and the lid can be turned with a light force. Subsequently, the each ledge portion 15 passes through a depressed groove formed of the first guide portion 30, the second guide portion 40, and the container side skirt portion 24. In the course of passing, each ledge portion 15 is guided along a slope of the first guide portion 30 and in contact with the first guide portion 30 and is gradually drawn in downward. In other words, the entire lid 10 is caused to move downwardly, namely, toward the container body 20 side. Then, each ledge portion 15 passes over the bump 33 and goes into the hollow portion 34, where the lid attaching operation ends.

During this turning, each ledge portion 15 is guided while contacting the first guide portion 30 and is gradually drawn in downward, in the course of which the resistance becomes higher than before. Thus, in a state in which a force is applied to the fingertips and in a position in which the lid side upper skirt portion 14 is pressed inward, the lid 10 is turned. At this time, a fingertip may contact the tip of the reinforcing horizontal flange 24*c* formed on the lower end of the container side skirt portion 24, which may cause incised wound on the fingertip or the like. However, in the lid 10 of the above embodiment, as described above, the lid side skirt portion 14 is formed long such that the lower end of the lid side skirt portion 14 is positioned lower than the lower end of the container side skirt portion 24 (position of the reinforcing horizontal flange 24*c*), and it does not occur that the reinforcing horizontal flange 24*c* is exposed to outside, which prevents the fingertips from carelessly being scratched.

Furthermore, while the entire lid 10 is caused to move toward the container body 20 side, the lid internal sidewall portion 12 is gradually press-fitting with the container internal sidewall portion 22. As a result, the "circumferential seal portion" described based on FIG. 4 is in a press-fit state. Thus, a liquid-tight seal portion having a higher liquid-tight performance in comparison with a case of simple press-contacting is formed between the lid internal sidewall portion 12 and the container internal sidewall portion 22. Note that in the embodiment illustrated in FIG. 4(*d*), θ1=θ2 is desirable, but press-fitting causes a slight deformation on both, as a result of which the conical surface forming the container internal sidewall portion 22 is placed in surface contact with the conical surface forming the lid internal sidewall portion 12 to form a circumferential seal portion. Therefore, a slight difference between θ1 and θ2 does not prevent an intended purpose from being achieved.

As described above, the container internal sidewall portion 22 is a portion continuing to an upper edge of the container body sidewall 20*a* of the container body 20 and is hard to be deformed by an external force in comparison with the skirt portion. Therefore, after the lid is attached, even if an external force is applied to the container with lid from other direction, there is a very low probability that have a gap in the "circumferential seal portion", and thus can prevent internal solution from leaking out with high probability.

Note that in the illustrated example, as described above, the distance h from the upper end of the horizontal portion 32 continuing to the first guide portion 30 to the first flange portion 23 is greater than the distance H from the top surface of a ledge portion 15 of the lid 10 to the second flange portion 13. Therefore, at a time when the lid attaching operation completes, the second flange portion 13 of the lid 10 is in a press-fit state at a required pressure against the first flange portion 23 of the container body 20. Thus, further excellent sealability between the container body 20 and the lid 10 is maintained Note that in this example, the amount of radial outward projection of the first guide portion 30 is small in the portion 25 of the first flange portion 23 and becomes gradually larger as it goes downward. The rising wall 31 is formed along the slope. For this reason, even if each ledge portion 15 is placed on the portion 25 of the first flange portion 23, the each ledge portion 15 can be dropped onto the second guide portion 40 simply by slightly turning the lid 10 forward and backward, which makes the lid attaching operation easier. Further, the first guide portion 30 may be formed to be slightly inclined upward also in a radial direction and the top surface side of the ledge portion 15 may be formed to be inclined in a radial direction, which can satisfy both ease of tightening and ease of molding.

When the lid 20 is opened, the lid 10 is turned counterclockwise. With the turn, each ledge portion 15 of the lid 10 moves through the depressed groove formed of the first guide portion 30, the second guide portion 40, and the container side skirt portion 24 while the lower edge portion on the frontside in the turn direction is moving along the second guide portion 40. Then, the lid is disconnected from the container body. After disconnection, the lid 10 can be removed by lifting the lid 10 at an appropriate position.

When the lid 10 is detached, first, a large force acts on the fingertips. As the ledge portion 15 moves on the horizontal region 42 of the second guide portion 40, the resistance is reduced and thereby the lid is easily turned. At that time, if the reinforcing horizontal flange 24*c* that is the lower end of the container side skirt portion 24 is exposed to outside, there is a possibility that the fingertips get incised wound by contacting it. Here, the reinforcing horizontal flange 24*c* is covered with the lid side lower skirt portion 14*b* of the lid side skirt portion 14, which prevents the fingertips from carelessly being scratched.

Note that the embodiment illustrated in FIG. 7(*a*) illustrates a state in which the lid side skirt portion 14 has the shortest length. If the length is longer than this shortest length, it is possible to achieve the intended purpose. For example, as illustrated in FIG. 7(*b*), in a state in which the lower end side of the ledge portion 15 of the lid 10 press-contacts against the first flange portion 23 of the container body 20, the lid side skirt portion 14 is preferably formed to have a length enough to cover the reinforcing horizontal flange 24*c* on the side of the container body 20 with the lid side lower skirt portion 14*b* of the lid side skirt portion 14.

Figure 5:
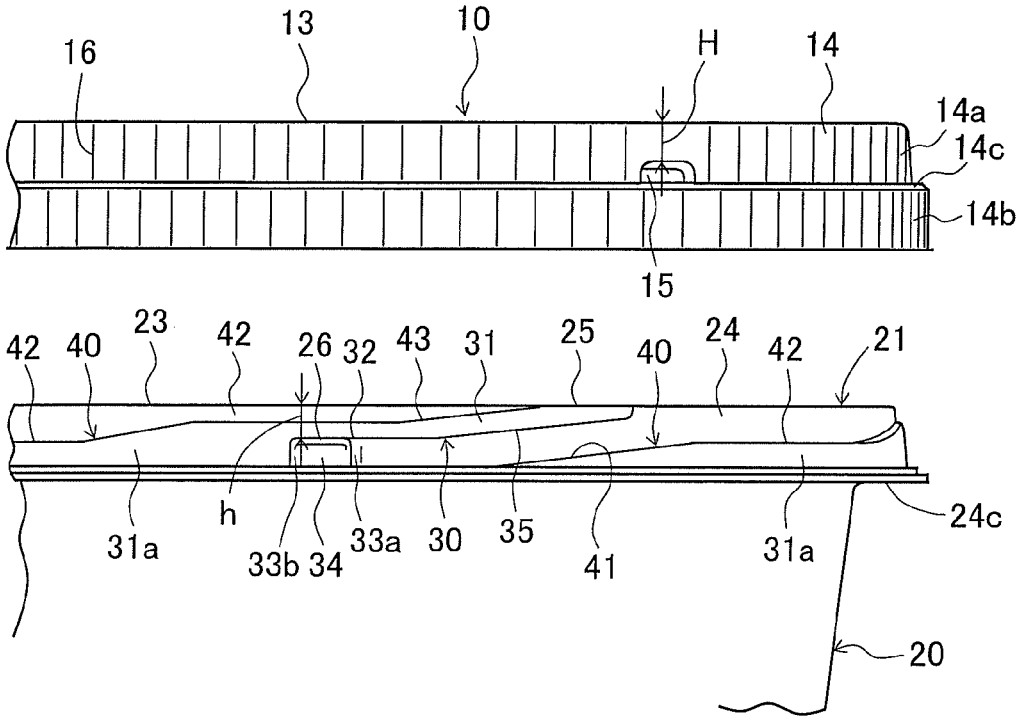
FIG. 5 is an enlarged view of the essential parts of the container with lid illustrated in FIG. 1.
Figure 6:
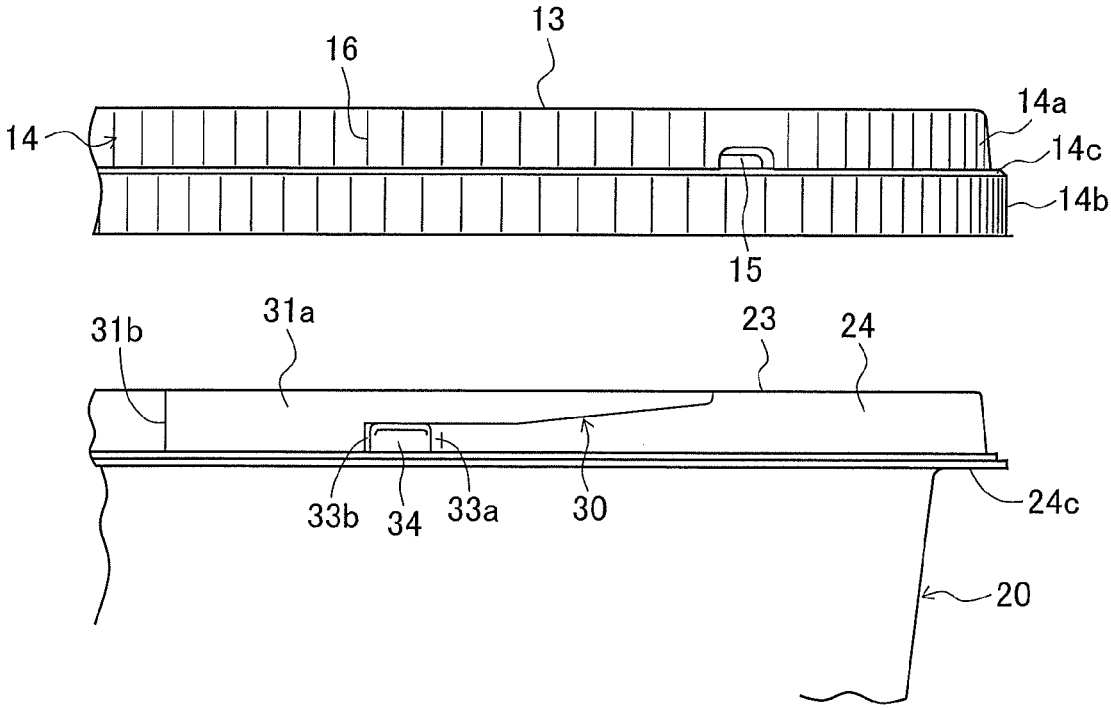
FIG. 6 is an enlarged view of the essential parts of a container with lid according to still another embodiment of the present invention.

FIG. 6 is illustrates another embodiment of the container with lid according to the present invention, which corresponds to FIG. 5. This embodiment is different from the first embodiment in that the container with lid 1 does not have the second guide portion 40. Moreover, in FIG. 6, reference character 31*b* denotes a terminal portion of the concentrically extending portion 31*a* of the rising wall 31 and is provided at an appropriate position. Except the above, the configuration is the same as that of the container with lid 1 in the first embodiment and the same reference numeral or character is assigned to the same component.

Likewise, in this embodiment, when the lid 10 is turned clockwise in the figure in a state in which the lid 10 is sunk in at a required pressure, the upper edge portion on the frontside in the turn direction of each ledge portion 15 contacts the first guide portion 30. Then, the each ledge portion 15 is guided along a slope of the first guide portion 30 being in contact with the first guide portion 30 and gradually caused to move downwardly. Then, as described above, at a time when the lid attaching operation completes, the second flange portion 13 of the lid 10 is in a press-lit state at a required pressure against the first flange portion 23 of the container body 20. Thus, sealability between the container body 20 and the lid 10 is maintained.

In the case of this embodiment, in a state in which the lower end side of the ledge portion 15 of the lid 10 press-contacts against the first flange portion 23 of the container body 20, the lid side skirt portion 14 preferably has a length enough to be positioned lower than the reinforcing horizontal flange 24*c* on the side of the container body 20. Thus, it is possible to effectively avoid the fingertips from carelessly being scratched when the lid 10 is attached or detached.

In the figure, four protrusions are formed on the lid 10, but the number of protrusions is not limited as long as two or more protrusions are formed, though not illustrated. Obviously, the number of first guide portions 30 corresponding to the number of protrusions should be formed on the container body 20 and if necessary, the number of second guide portions 40 corresponding to the number of protrusions should be formed on the container body 20. Preferably, each protrusion is provided with a circumferentially equal interval.

Note that in the illustrated example, the lid side skirt portion 14 includes the lid side upper skirt portion 14*a*, the reinforcing horizontal flange 14*c*, and the lid side lower skirt portion 14*b*, but the reinforcing horizontal flange 14*c* can be omitted as long as a required strength can be obtained. Note also that fine uneven processing or embossing processing by thermoforming may be performed on and near the reinforcing horizontal flange 24*c* on the side of the container body 20 to provide an outer edge line, namely, an outer edge line not a straight line of a waveform (such as sine wave, triangular wave, trapezoidal wave) in a side view. This can eliminate the sharp edge of the outer peripheral edge, which can further improve the effect of protecting the fingertips when the container body 20 is handled by itself. This can also provide the effect of reinforcing the container side skirt portion 24.

All publications, including patents and patent applications cited in this specification are herein incorporated by reference.

REFERENCE SIGNS LIST

1 container with lid
10 lid
10*a* lid top surface portion
11 peripheral portion of lid
12 lid internal sidewall portion
13 second flange portion
14 lid side skirt portion
14*a* lid side upper skirt portion
14*b* lid side lower skirt portion
14*c* reinforcing horizontal flange
15 ledge portion
16 rib
20 container body
20*a* container body sidewall
21 upper opening portion
22 container internal sidewall portion
23 first flange portion
24 container side skirt portion
24*c* reinforcing horizontal flange
26 lower end portion of first guide portion
30 first guide portion
31 rising wall
31*a* concentrically extending portion of rising wall
32 horizontal portion
33 bump
34 hollow portion
40 second guide portion
41 first sloping region of second guide portion
42 horizontal region of second guide portion
43 second sloping region of second guide portion
r1 radius of upper end of lid internal sidewall portion
r2 radius of lower end of lid internal sidewall portion
r3 radius of upper end of container internal sidewall portion
θ1 tilt angle of container internal sidewall portion with respect to vertical centerline
θ2 tilt angle of lid internal sidewall portion with respect to vertical centerline

The invention claimed is:

1. A container with lid comprising:

a container body, comprising:

a container sidewall having an upper end defining a substantially circular opening;

a first flange extending outward from the upper end of the container sidewall; and a container side skirt extending downward from an outer edge of the first flange, the container side skirt having a free lower end; and a lid attachable to and detachable from the upper end of the container body, the lid comprising:

a lid internal sidewall having an outer surface that press-contacts against an inner surface of the container sidewall over an entire circumference when the lid is attached to the container body, such that a circumferential liquid-tight press-fit seal is formed between the outer surface of the lid internal sidewall and the inner surface of the container sidewall;

a second flange extending outward from an upper end of the lid internal sidewall;

a lid side skirt extending downward from an outer edge of the second flange, the lid side skirt having a free lower end, and two or more ledge portions protruding inward formed on the lid side skirt, wherein in a state in which a lower end side of one of the ledge portions formed on the lid side skirt press-contacts against the first flange formed on the upper end of the container sidewall, the lid side skirt is formed such that the free lower end of the lid side skirt is positioned lower than the free lower end of the container side skirt, and wherein the container side skirt of the container body has a first guide that guides downward the ledge portions formed on the lid side skirt when the lid is being placed on the upper end of the container body and turned in a tightening direction to close the opening.

2. The container with lid according to claim 1, wherein the container sidewall and the lid internal sidewall have a cylindrical surface or an upward-expanding cone surface, and satisfy one of the following either relations: $r1 \geq r3$ and $0° \leq \theta1 < \theta2$; $r1 \leq r3$ and $\theta1 > \theta2 \geq 0°$; or $r1 > r3$ and approximately $\theta 1=\theta 2\neq 0°$, where r1 denotes the radius of the upper end of the lid internal sidewall, r3 denotes the radius of the upper end of the container sidewall, θ1 denotes the tilt angle of the container sidewall, and θ2 denotes the tilt angle of the lid internal sidewall with respect to a vertical centerline.

3. The container with lid according to claim 1, wherein when the lid is being put onto the container body in a tightening direction, the ledge portions are guided downward by the first guide and the lid is caused to move downwardly, and by being drawn in, the first flange and the second flange are in a press-fit state.

4. The container with lid according to claim 1, wherein a region on the outer surface of the lid internal sidewall has a greater diameter than a corresponding region on the inner surface of the container sidewall when the lid is attached to the container body, thereby allowing the region on the lid internal sidewall to press-contact against the corresponding region on the container sidewall when the lid is attached to the container body.

5. The container with lid according to claim 1, wherein the container side skirt is positioned to surround at least a portion of the container sidewall.

6. The container with lid according to claim 1, wherein a surface of the lid internal sidewall that is opposite to the seal is exposed to an outside atmosphere.

7. The container with lid according to claim 1, wherein the container body and the lid are made of a thermally sheet-formed synthetic resin sheet.

8. The container with lid according to claim 7, wherein the thermally sheet formed synthetic resin sheet has a thickness that ranges from 0.2 mm to 1.0 mm.

9. A container with lid comprising:

a container body, comprising:

a container sidewall having an upper end defining a substantially circular opening; and a container side skirt extending downward from the upper end of the container sidewall, the container side skirt having a free lower end; and a lid attachable to and detachable from the container body, the lid comprising:

a lid internal sidewall having an outer surface that press-contacts against an inner surface of the container sidewall over an entire circumference when the lid is attached to the container body, such that a circumferential liquid-tight press-fit seal is formed between the outer surface of the lid internal sidewall and the inner surface of the container sidewall;

a lid side skirt extending downward from an upper end of the lid internal sidewall, the lid side skirt having a free lower end; and two or more ledge portions protruding inward formed on the lid side skirt;

a first guide that guides downward the ledge portions formed on the lid side skirt when the lid is being put onto the container body in a tightening direction; and a second guide that guides upward one of the ledge portions in a position in which a lower end side of the one of the ledge portions is in contact with the second guide when the lid attached to the container body is being moved away from the container body, the second guide having a horizontal region substantially parallel to the upper end of the container sidewall, wherein in a state in which the lower end side of the one of the ledge portions formed on the lid side skirt press-contacts against the horizontal region of the second guide, the lid side skirt is formed such that the free lower end of the lid side skirt is positioned lower than the free lower end of the container side skirt.

10. The container with lid according to claim 9, wherein the container sidewall and the lid internal sidewall have a cylindrical surface or an upward-expanding cone surface, and satisfy one of the following either relations: $r1\geq r3$ and $0°\leq\theta 1<\theta 2$; $r1\leq r3$ and $\theta 1>\theta 2\geq 0°$; or $r1>r3$ and approximately $\theta 1=\theta 2\neq 0°$, where r1 denotes the radius of the upper end of the lid internal sidewall, r3 denotes the radius of the upper end of the container sidewall, θ1 denotes the tilt angle of the container sidewall, and θ2 denotes the tilt angle of the lid internal sidewall with respect to a vertical centerline.

11. The container with lid according to claim 9, wherein when the lid is being put onto the container body in a tightening direction, the ledge portions are configured to be guided downward by the first guide to allow the lid to move downwardly, thereby allowing the first flange and the second flange to be positioned in a press-fit state.

12. The container with lid according to claim 9, wherein a region on the outer surface of the lid internal sidewall has a greater diameter than a corresponding region on the inner surface of the container sidewall when the lid is attached to the container body, thereby allowing the region on the lid internal sidewall to press-contact against the corresponding region on the container sidewall when the lid is attached to the container body.

13. The container with lid according to claim 9, wherein the container side skirt is located to surround at least a portion of the container sidewall.

14. The container with lid according to claim 9, wherein a surface of the lid internal sidewall that is opposite to the seal is exposed to an outside atmosphere.

15. The container with lid according to claim 9, wherein the container body and the lid are made of a thermally sheet-formed synthetic resin sheet.

16. The container with lid according to claim 15, wherein the thermally sheet formed synthetic resin sheet has a thickness that ranges from 0.2 mm to 1.0 mm.

17. A container with lid, comprising:

a container body, comprising:

a container sidewall having an upper end defining a substantially circular opening; and a container side skirt extending downward from the upper end of the container sidewall; and a lid attachable to and detachable from the upper end of the container body, the lid comprising:

a lid internal sidewall having an outer surface that press-contacts against an inner surface of the container sidewall over an entire circumference when the lid is attached to the container body, such that a circumferential liquid-tight press-fit seal is formed between the outer surface of the lid internal sidewall and the inner surface of the container sidewall;

a lid side skirt extending downward from an upper end of the lid internal sidewall; and two or more ledge portions protruding inward formed on the lid side skirt;

a first guide that guides downward the ledge portions formed on the lid side skirt when the lid is being put onto the container body in a tightening direction; and a second guide that guides upward one of the ledge portions in a position in which a lower end side of the one of the ledge portions is in contact with the second guide when the lid attached to the container body is being moved away from the container body, the second guide having a horizontal region that is substantially parallel to the upper end of the container sidewall, wherein in a state in which the lower end side of the one of the ledge portions formed on the lid side skirt press-contacts against the horizontal region of the second guide, the lid side skirt is formed such that the free lower end of the lid side skirt is positioned lower than the free lower end of the container side skirt, and wherein the first guide does not extend to a location above the horizontal region in the second guide.

* * * * *